United States Patent [19]

Moraly

[11] Patent Number: 4,921,200

[45] Date of Patent: May 1, 1990

[54] PEG FOR FIXING POSTS OR STAKES IN THE GROUND

[76] Inventor: Paul Moraly, 168-170, rue Victor Hugo, 93110 Rosny Sous Bois, France

[21] Appl. No.: 246,030

[22] Filed: Sep. 14, 1988

Related U.S. Application Data

[63] Continuation of Ser. No. 119,252, Nov. 6, 1987, abandoned, which is a continuation of Ser. No. 717,922, Mar. 29, 1985, abandoned.

[30] Foreign Application Priority Data

Aug. 16, 1984 [FR] France ..... 84 12858

[51] Int. Cl.[5] ..... F16M 13/00

[52] U.S. Cl. ..... 248/545; 52/155

[58] Field of Search ..... 248/545, 565, 156, 530, 248/532, 508; 135/118; 52/165, 155, 156, 153

[56] References Cited

U.S. PATENT DOCUMENTS

| | | | |
|---|---|---|---|
| 606,558 | 6/1898 | Ketchum | 248/156 |
| 1,543,392 | 6/1925 | Knophe | 52/153 |
| 1,968,309 | 7/1934 | Paque | 52/155 |
| 2,086,213 | 6/1937 | Collord . | |
| 3,132,726 | 5/1964 | Johnson . | |
| 3,286,416 | 11/1966 | Ashworth | 52/153 |
| 3,775,924 | 12/1973 | McClure, Jr. | 52/153 |
| 3,896,596 | 7/1975 | Berger . | |
| 4,027,856 | 6/1977 | Kingsley | 52/155 |
| 4,084,914 | 4/1978 | Humphrey | 52/153 |
| 4,249,715 | 2/1981 | Repp | 248/545 |
| 4,483,506 | 11/1984 | Litwiller | 248/545 |
| 4,530,190 | 7/1985 | Goodman | 248/545 X |
| 4,553,358 | 11/1985 | Deike | 52/165 |
| 4,588,157 | 3/1984 | Mills | 248/545 |

FOREIGN PATENT DOCUMENTS

| | | |
|---|---|---|
| 7024837 | 3/1972 | France . |
| 2290052 | 5/1976 | France . |
| 2422797 | 11/1979 | France . |
| 2454503 | 11/1980 | France . |
| 2520160 | 7/1983 | France . |

*Primary Examiner*—Alvin C. Chin-Shue
*Assistant Examiner*—Sarah A. Lechok
*Attorney, Agent, or Firm*—William A. Drucker

[57] ABSTRACT

The present invention relates to a peg with insert sleeve as well as a process for using the peg for fixing posts or sticks in the ground.

8 Claims, 4 Drawing Sheets

FIG. 5
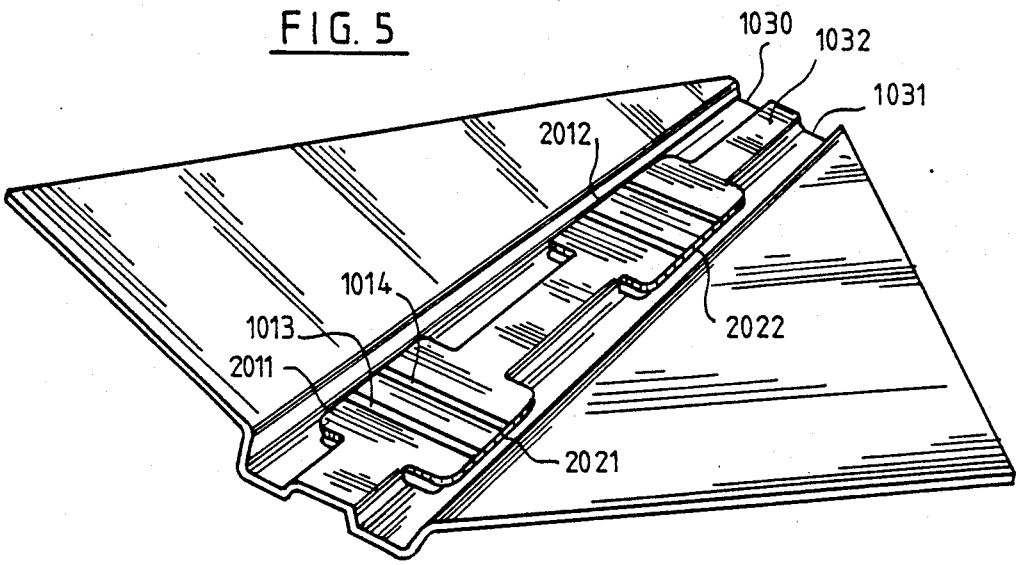
FIG. 6
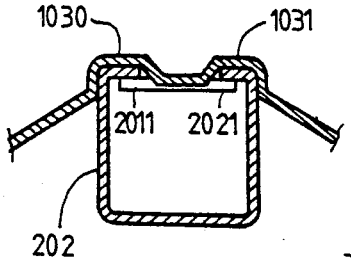
FIG. 7
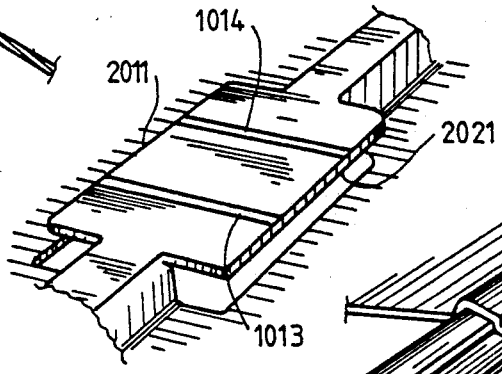
FIG. 8
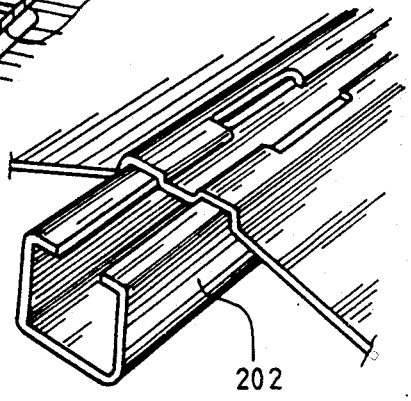
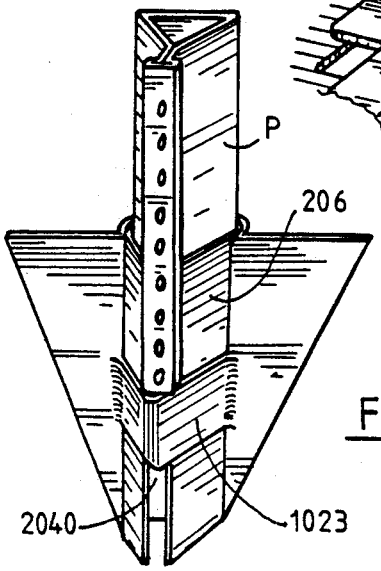
FIG. 9

PEG FOR FIXING POSTS OR STAKES IN THE GROUND

This application is a continuation, of application Ser. No. 119,252, filed Nov. 6, 1987, which is a continuation of Ser. No. 717,922 filed Mar. 29, 1985, now abandoned.

BACKGROUND OF THE INVENTION

1. Field of the Invention

The present invention relates to a peg with insert sleeve as well as a process for using said peg for fixing posts or sticks in the ground.

2. Description of the Prior Art

Of the four main methods of fixing posts or similar in the ground, the first one consists in preparing a hole in the ground, planting the base of the post at the bottom of the hole then filling it up. The disadvantage of this solution, in addition to the considerable amount of work (digging and filling in), is that it does not ensure a good stability for the post: filling in with the earth extracted only offering low resistance to the transverse forces exerted on the post. For this reason, filling in or packing with earth is replaced by concrete. This solution is time and labor wasting and costly in transporting the concrete. Another easier solution uses stabilizing means associated with the base of the post and engaged at the same time as this latter in the hole: after filling in, such stabilization (generally using radial projecting anchorage elements) ensures better fixing of the post.

In the patent UK No. 4 338 (John Dick) and UK No. 4 240 (J. H. Smith), the stabilizer is formed by the assembly of two pieces of metal sheeting each comprising at least one stabilizing fin, extending radially with respect to the post and at least one central or lateral bent part. These bent parts of the two pieces cooperate for defining a passage for the pole which is engaged therein so as to be held radially in position. In these examples, securing of the two pieces together is provided by engagement of the post which plays a role similar to the hinge pin of a hinge.

In U.S. Pat. No. 3,896,596, the stabilizer is formed from an anchorage plate with central window and an omega shaped removable assembly collar whose curved central part is introduced in the window until its side legs cme into abutment against one of the faces of the anchorage plate. The post is engaged in the curved part which projects on the other side of the plate, thus securing the whole together: post/collar/plate.

In the above described examples, before positioning the post, the stabilizer has to be fitted on the post before introducing the assembly into the hole.

A serious disadvantage of this solutions is that they require considerable sized holes to be dug for receiving the post and its stabilizing means.

The second method of fixing posts consists in driving them in by impact. That slightly compacts the ground about the post during penetration thereof, giving better stability in comparison with the post placed in a previously dug hole.

In numerous applications, that is insufficient and the addition of stabilizing means is necessary.

In the U.S. Pat. No. 2,086,213 the post is axially extended, at its base, by a pointed spade whose upper part projects laterally from the post, serving as abutment surface and stabilizer.

A weighted sleeve slides along the post and forcibly strikes the spade, for driving the post into the ground.

The spade must therefore be massive and very rigid, resulting in particularly costly and dissuasive spade/-stake prices for a large number of applications, in particular in stony and rocky ground where driving in of the posts is not easy, even impossible.

The third fixing method consists in placing the stabilizing means after the post has been driven into the ground. In U.S. Pat. No. 3,132,726 (Grandy Johnson) and F.R. No. 2 097 389, stabilization is obtained by a rectangular metal plate or a metal plate shaped with a point towards the bottom with, in its middle part, a collar (obtained by cutting out and stamping) having the same dimension as the section of the post, for slidably mounting on this latter. Once the base of the post has been driven into the ground, it is stabilized by sliding the plate to the ground where it is driven in by impact, which damages the galvanisation or the coating of the post. In U.S. Pat. No. 3,132,726, a sleeve sliding on the post is used for driving in said stabilizer.

The solutions proposed in these three patents do not resolve the problem of driving in the post (particularly when they are of large size and in rocky ground). Traditional posts can only be driven directly into light or loose soil. These solutions as well as the preceding ones do not allow ready removal of the post and, consequently, replacement thereof, and thus, on this score, are no better than the traditional techniques which they wished to rival.

The fourth method consists in using a peg, driven in previously, in which the post is engaged.

In French Pat. No. F.R. 2 290 052, the peg comprises a massive tubular body whose upper end is open and whose lower end is closed by a conical portion itself extended by a pointed axial rod.

This peg is relatively complex and costly to manufacture, and its parts can be neither simplified nor omitted: the rod for correct guiding, the conical portion for facilitating preperforation and preventing penetration of the earth and wings integral with the body for stabilizing purposes.

The applicant has corrected the above mentioned dificiencies. His patent F.R. No. 2 422 793 provides a very advantageous process with a special peg, driven into the ground using an appropriate tool: the peg, intended for fixing posts or stakes in the ground, comprises anchoring fins defining, by their bent edges, a sleeve substantially equal to the total height of the peg. Said sleeve forms the housing for the base of a post or stake.

In a first addition No. 79-09679, the applicant provides a peg formed by an assembly of two metal zig zag plates, each forming a single fin. According to the process, the peg is placed on the ground and the shank of a driving and guiding too, which passes through and completely occupies the sleeve, is introduced therein. This shank, slighly longer than the sleeve is provided at its upper part with a stop which bears on the fins and allows the peg to be driven into the ground. Then, the tool is removed and is replaced by the post in the sleeve. The peg is driven in (vertically or angularly) along the axis of the tool, without being deformed, and the shank does not let earth penetrate into the sleeve. To prevent the top of the sleeve from being bruised by the driving in shocks which would adversely affect the subsequent positioning of a post or stake, the stop comprises a recess around the shank, on its bearing face. The peg is guided accurately all the more so since the shank and the sleeve have identical or complementary sections, at least over a part of their length. It is troublesome to have to store shanks of several sections matching the different profiles of the peg sleeves. The applicant has overcome this drawback in his patent F.R. No. 82-09944 by associating with the tool a set of insertable and removable sleeves for matching the section of the shank to the peg sleeves of different sections.

The pegs described in patent F.R. No. 2422793 and the first addition 7909679 can only be used for a given post or stake section, which hereagain involves a considerable and varied stock of parts.

SUMMARY OF THE INVENTION

The purpose of the invention is to overcome these disadvantages. The new peg offers, in addition to the advantages provided by the above mentioned patents of the applicant, a simplified manufacture, a broadening of the capacities for receiving different posts and stake sections an reducton of the stock in volume and in number of the pegs to be stored (fewer varieties required).

For this, it provides a peg comprising an anchorage piece whose central surface portion or middle part extends over the whole height of the piece, along a median axis corresponding to the driving-in axis of the piece.

at least two fins whose upper edge is intended to receive the impact forces and in which at least one part of the lateral edge portion is slanting with respect to the driving-in axis, so as to promote penetration into the ground, first assembly means provided on each side of the middle part, forming elongate and flat housings, a removable sleeve, in the form of a shaped section, having a length equal to that of the anchorage piece and a section varying in dependence on that of the corresponding post or stake, second assembly means, in the form of lateral flat portions, cooperating on this sleeve with said first means for ensuring fixing of the above mentioned removable sleeve on the middle part, coaxially with the driving-in axis.

Temporary assembly is then provided by sliding the flat portions of the removable sleeve in the flat and elongate housings of the anchoring piece, parallel to the driving in axis.

Contary to what was stated in the above mentioned application in which the applicant proposed an improvded tool (for driving in and guiding the pegs), whose shank was provided with an abutment surface or stop comprising a lower surface having a hollow central part (for preserving the top of the sleeve of the peg from bruising caused by the impacts, which may prevent removal of the tool and introduction of the post or stake), the present invention proposes no longer preserving the top of the sleeve, but deforming it advantageously.

The new splaying tool is not only a tool for driving but also for gripping and splaying which, during driving in of the peg, completes the top of the sleeve of this latter. The temporary assembly thus becomes final and irreversible.

The invention provides improvements facilitating: gripping, positioning of the peg at the position where it is to be driven into the ground, removal of the tool and introduction of the post or stake into the sleeve once the peg is driven in.

The new tool comprises, at the junction between the abutment piece and the shank (in place of the anti-bruising hollow) a shape opening out progressively from said shank, to said abutment piece, so as to ensure:

gripping of the peg: the shank is introduced into the sleeve until the upper orifice is jammed against the opened out or splayed shaped. The peg is firmly secured to the tool, which allows it to be transported while being suspended to the desired place where it is to be driven in, the formation of a splayed portion by progressive deformation of the upper part of the sleeve in accordance with the splay of the shank, under the impacts, such a splayed portion facilitating removal of the tool and introduction of the stake or post, concentration of the impacts and guiding applied to the peg by the tool along the driving-in axis and in line with the central part which is more resistant than the stabilizing fins, splaying firmly securing the two pieces of the peg together and providing better and final cohesion by means of this splayed portion, in accordance with one feature of the invention formation of said splayed portion is facilitated by the fact that the walls of the sleeve, in particular at the level of its upper part, are thin and free of appreciable extra thick portions and are consequently suitable for being deformed.

If it is desired to adapt to the tool the removable insertable sleeve described in patent F.R. 8209944, a splayed part exactly matching that which connects the abutment piece to the shank of the tool is formed at its upper end.

BRIEF DESCRIPTION OF THE DRAWINGS

Other features and advantages of the invention will be clear from the following description, with reference to the accompanying drawings in which:

FIG. 1 is a perspective view of a peg, with

FIGS. 5 and 6 show another embodiment respectively in perspective and in cross section;

FIG. 7 is a partial view of the tongues which the anchorage piece of FIG. 5 comprises;

FIG. 8 shows partially, in perspective, the anchorage piece of FIG. 5 assembled with the added (and only partly engaged ) sleeve element of FIG. 6;

FIG. 9 illustrates in perspective one embodiment in which the sleeve is entirely formed by an added element;

FIG. 19 is a perspecive view showing the projection of the pointed shank of the tool with respect to the truncated cone shaped part of a peg ready to be driven in;

DESCRIPTION OF THE PREFERRED EMBODIMENTS

The peg shown in FIGS. 1 to 4 and 18 comprises an anchorage piece 1 formed from a single cut-out metal sheet bent to form fins 101 and 102 jointed to the central part 103 and forming two flat elongate housings 1010 and 1020 open on one side and at both ends, for receiving the bent portions of a sleeve element such as 201, 202, 203, 204, 205.

Defining, by their shape, an axis XX' and a driving direction F, the fins 101 and 102 are slanted symetrically with respect to the middle part 103 so as to recenter the driving-in force with respect to the volume determined by the whole of the peg and so as to obtain stabilized multidirectional anchorage.

The two flat housings 1010, 1020 reinforce also the longitudinal and central strength of the peg, where the impacts are concentrated.

Figure 1:
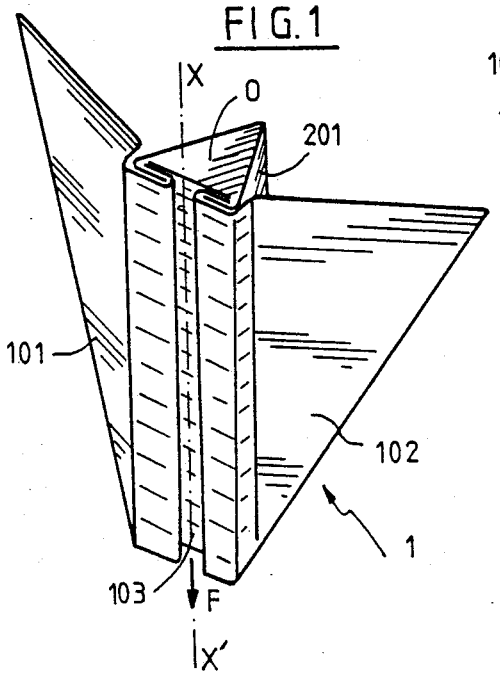
Figure 2:
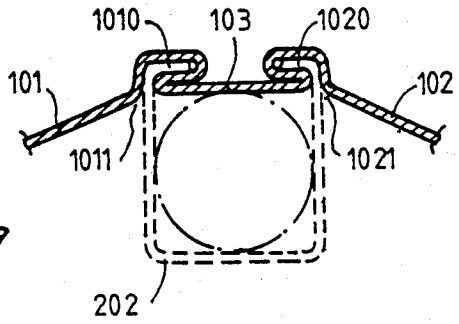
FIGS. 2 and 3 showing the respective sections of the anchorage piece and an element of the sleeve according to two different embodiments.
Figure 3:
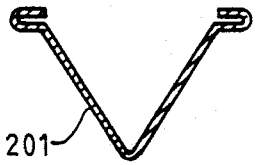
Figure 4:
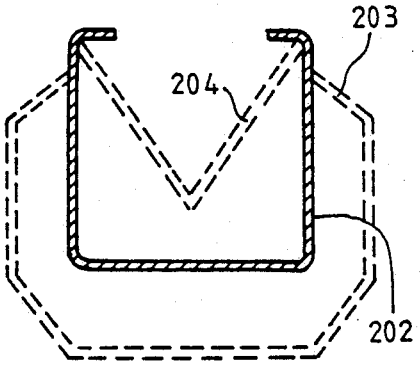
FIG. 4 shows different possible sections for the sleeve element adaptable to the same anchorage piece as that shown in FIG. 2, only the flat portions being identical.
Figure 19:
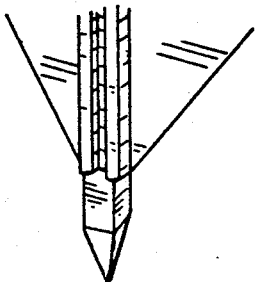

FIG. 2 shows, with broken lines, the sleeve element 202 and the middle part of peg 103 situated at an appropriate distance from the face of the sleeve which is paralle to said middle part. The junctions (between the outer bends of the middle part 103 and fins 101 and 102) form projecting abutment surfaces 1011 and 1021 which prevent the two inserted faces of the sleeve 202 from moving aside. The peg and the sleeve which is solid therewith over the whole of its height have an evolute maximizing the contact area with the abutment surface of the shank. The base of the peg has a truncated shape for economizing metal, the edge of the pointed end of the tool being sufficient for driving in (FIG. 19).

Figure 18:
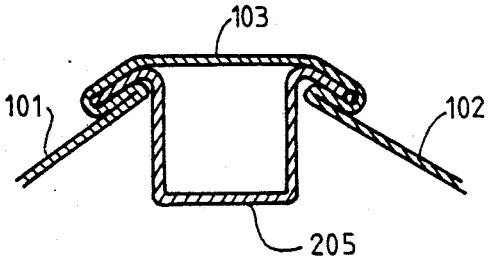
FIG. 18 is a schematical sectional view of a peg in which the first and second assembly means are bent outwardly instead of inwardly. This version, with tongues instead of bends, facilitates manufacture, particularly with a smooth central part and a sleeve having external flat portions. That makes it impossible for the lateral sides of the sleeves to splay out.

In a variant of shape and arrangement, the bends of the anchorage piece and the flat portions of the sleeve open towards the axis of symmetry of the peg and not towards the fins (FIG. 18). In FIG. 2, the bends are simpler and better protect the bend lines should they come up against stones.

Since it may project outwardly and not inwardly of the volume defined by the fins, the middle part 103 may even form a separate part assembled to two separate fins; the three parts of the anchorage piece and the sleeve form, by means of the bent edges, a peg reducing storage requirements but penalising the use and manufacture thereof.

The open sleeve is only closed by its junction to the central part of the anchorage piece. If recentering of the driving forces with respect to the volume defined by the fins is respected, the role of the two pieces forming a complete sleeve may be more or less equal: each of these two pieces may even be given the role of a half sleeve body. In one of the embodiments shown in FIGS. 1 to 4, the added sleeve element is guided and received by flat housings formed by bends of a length equal to that of the anchorage element so that the shank of the tool occupies the whole of the sleeve and prevents an penetration of earth therein.

One of the embodiments shown in FIGS. 5, 6 and 7 shows that the flat housings do not need to extend continuously over the whole height of the peg; instead of the continuous guide and housing bends for the element of the inserted sleeve, two pairs of tongues 1011–1021 and 1012–1022 are preferred which are obtained by cutting out and stamping the central part of the anchorage piece. The surface of the tongues is preserved from stamping so as to remain in the plane of the upper face of the parallelepipedic boss 1032 while partially overlapping two gutters 1030–1031 separated by this boss 1032. These pairs of tongues are sufficient, in cooperation with the gutters for guiding and holding in position the bent edges or flat portions of the insert sleeve element 202 shown partially engaged on the anchorage piece in FIG. 8.

Sleeve elements with different shapes and dimensions may be fixed to the same anchorage piece for receiving posts or stakes of different sections.

Advantageously, stiffeners such as 1013–1014 (FIGS. 5 and 7) are formed from the flat surface common to the two tongues of the same pair and on the intermediate boss surface, for preventing accidental sliding of the post and of the element of the sleeve.

The anchorage piece shown in FIGS. 5 to 8 may be advantageously formed by pressing, the sleeve then being obtained from continuous shaped sections.

Sleeve 206, an indpendent inserted piece, may have a closed triangular, circular, rectangular or other section, but may also be opened over the whole of its length as shown in FIG. 9, which allows it to receive a post P of "ELKOSTA" type (Elkosta is a registered trademark) whose T shaped projection will pass through slit 2040 towards the outside of the sleeve and will lock the post at the level of the upper edge of collar 1023. The penetration of earth into the sleeve through this slit is negligible and in no wise hinders introduction of the post.

Figure 10:
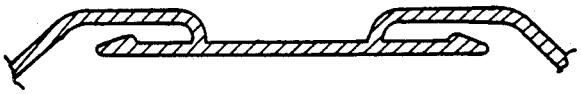
FIGS. 10 and 11 show, in cross section, respectively the anchorage piece and the added sleeve elements, in a form obtainable by extrusion or protrusion.
Figure 11:
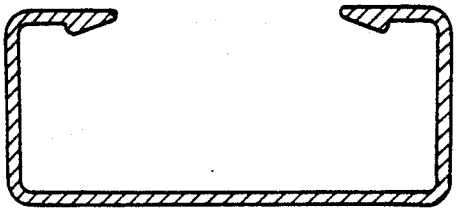

The peg of FIGS. 10 and 11 is extruded. For facilitating driving in, the fins of the anchorage piece have a certain slope through oblique cuts.

To reduce the number of models of insertable sleeves and driving-in tools, the compatibility of posts and tool shanks with larger sleeve sections is obtained by inserting an additional wedging piece or "compensation sheath" (a role played by the removalbe insert sleeve). Made from metal or a plastic material, adhesive or not, it remains in the sleeve after the post has been positioned and envelopes it wholly or partly, depending on its shape (strip, tube, or other). Simple wedging of the post may be sufficient ( a single face in the case of a triangular section).

Figure 14:
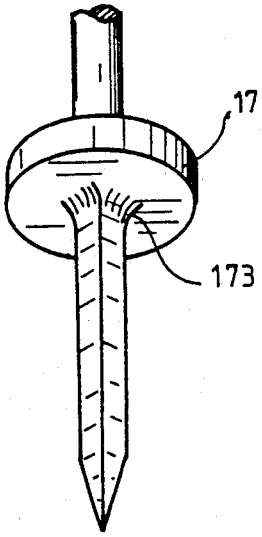
FIG. 14 is a perspective view showing the splayed portion of the tool at the junction between the shank and the abutment piece.
Figure 15:
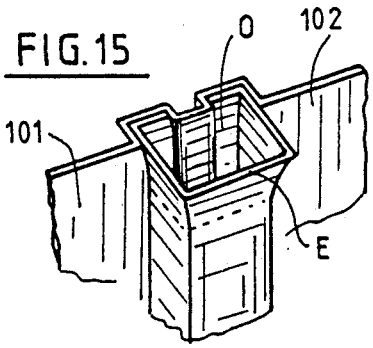
FIG. 15 is a perspective view showing the deformation obtained on the peg by the splayed part of the tool.

In its variants, the peg is driven in using the following tools:

with a normal too, the peg C is disposed at the position where it is to be driven in, then the shank of the tool, whose outwardly projecting point penetrates into the ground, is engaged in its sleeve.

with the splaying tool, the peg C is disposed on the shank where it is jammed against the splayed portion 173 (FIG. 14), which allows the peg to be gripped by jamming in the opening O of the panel (FIG. 15) and causes with the first impacts widening or splaying of the upper part of the sleeve. Thus, during driving in, correction of the two pieces of the peg together by crimping (anchorage piece/sleeve) is improved as also recentering of the shocks exerted along the central axis of the peg on the abutment piece 17 in FIG. 12 and then, after driving, in extraction of the tool and introduction of the post.

In both cases, after introduction of the shank of the tool in the peg, and under the shocks of ram 16 on the abutment piece 17, the peg penetrates into the ground. After passing slightly beyond the level of the ground, the tool is withdrawn then the post fitted without the packed earth having been able to penetrate into the sleeve.

The projection (immpetus and release) of the ram along the guide of the tool above the abutment piece, increases the mass of this ram to such an extent that the forces transmitted to the point of the shank projecting from the truncated cone shaped base of the peg (FIG. 19) pulverise substantial rocks.

Figure 12:
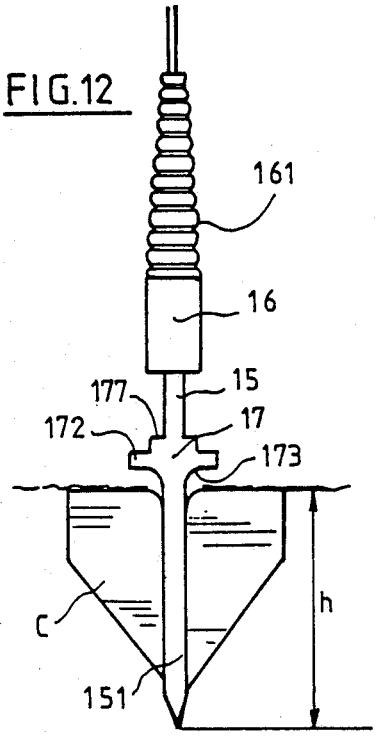
FIG. 12 is a schematical section illustrating the method of driving the peg into the ground, using a manual tool.

FIG. 12 shows, projecting from the sleeve of a peg during driving-in, the point of a shank 151 having an abutment piece 17 whose lower face 172 and splayed shape 173 bear on peg C and whose upper face 177 receives the blows of the ram 16 (with ribs 161 which are easy to grasp) sliding on guide 15.

Figure 16:
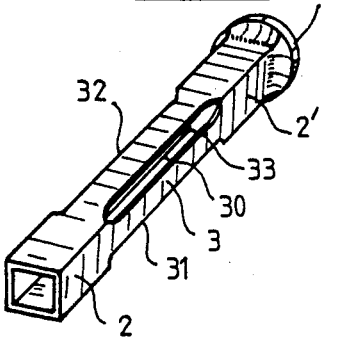
FIG. 16 is a perspective view of a removable insert sleeve matching the section of the shank of the tool to pegs of different sections.
Figure 17:
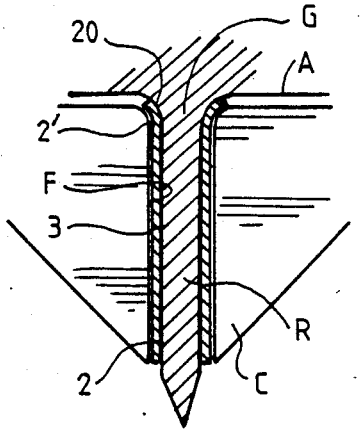
FIG. 17 is a general section showing the bearing surface of the abutment piece of the shank of a tool, a part of the peg on which the tool bears and a removable insert sleeve, in position about said shank.

In both cases, adaptation of the driving tool to different sleeve sections may be obtained by a removable matching insert sleeve whose central part 3 (FIG. 16–17) is provided or not with longtudinal recesses 30, 31, 32, 33 between ends 2 and 2', end 2 closely matching the shank R of the driving tool just above the point thereof.

Thus a set of sleeves is provided for adapting a single tool to pegs having sleeves of different sections.

Recesses 30, 31, 32, 33 prevent the sleeve from sticking to the sleeve of the peg and the central part of the shank of the tool.

Part 2' of the sleeve ends advantageously in a splayed part 20 matching that of the previously described tool and playing the same role.

Peg C is lighter in construction for it profits from preperforation and guiding by the tool.

The shank preserves the inside of the sleeve from shocks or flexions during driving-in, under the cumulated effect of the impacts or of hard bodies met with.

It also prevents any penetration of earth detrimental to subsequent fitting of the post.

Figure 13:
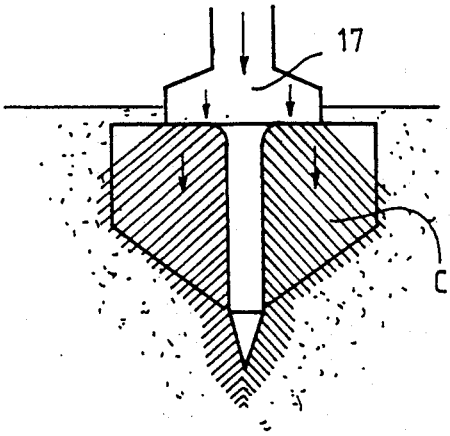
FIG. 13 is a schematical section showing the compacting of the earth about a peg driven-in in accordance with the process of the invention.

The guidance and strength of the pegs are not weakened when the fins are twisted or are torn when meeting hard points in the ground during driving-in, the strength being reinforced by:

the partial deformations and tears of the fins, compacting (effected by the point of the shank) of the earth moved along the sleeve (FIG. 13)

the very considerable compacting, effected by the abutment surface of the shank, at the head of the peg, below the level of the ground, at the end of drivingin when the impacts are continued.

Moreover, there may be provided on the fins:

stiffening bends which facilitate alignment thereof an allow stacking for packing;

perforations which facilitate rational deformation thereof so as to improve the anchorage and the interpentration of foreign bodies such as earth, roots, stones, etc. . .

Figure 20:
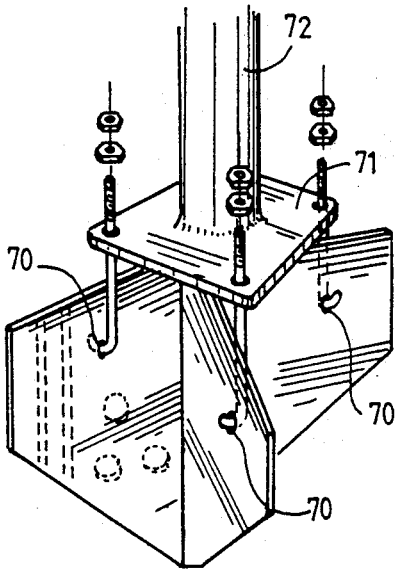
FIG. 20 is a schematical perspective view of a peg on which is fixed a post of large section, via a plate.

One example of these perforations and stiffening bends is shown with broken lines in FIG. 20. The fins may further comprise, as shown in this FIG. 20, perforations 70 which facilitate handling and storage, as well as the fastening of cables, hooks, etc. . . , in particular for locking thereto the base plates 71 of a post 72 of large section.

In this case, post 72 cannot penetrate into the sleeve, plate 71 is provided in place of the abutment surface of the tool, at the top of the sleeve and the fins, thus allowing tools of small section to be used for large-sized pegs and posts.

Figure 21:
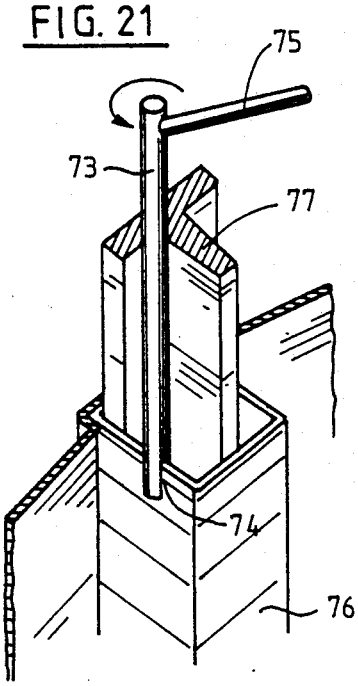
FIG. 21 is a schematical representation, in perspective, for illustrating crimping of a post using an appropriate tool.

For fixing the post to the peg, the top of the sleeve may be crimped by an impact or horizontal twist using an appropriate tool, such for example as the one shown in FIG. 21.

This tool comprises a rod 73 having at its lower end a slit 74 and at its upper end a cross arm 75. The tool is positioned so that its slit 74 is astride the upper edge of sleeve 76, nips it while penetrating partly into the ground and partly into the existing space between sleeve 76 and post 77. By rotating rod 73, using arm 75, the post 77 is thus crimped by reducing the section of the sleeve 76.

Positioning of stakes using pegs with separate sleeve driving tools in accordance with the present invention may be advantageously carried out in accordance with the process hereafter which comprises the following steps:

the choice of a separate sleeve corresponding to the section of the post or stake which it is desired to position, fitting the sleeve on an anchorage plate, positioning of the peg thus formed at the position where it is desired to drive in the post or stake, introduction into the sleeve of the shank of the driving tool, application of repeated impact forces on the driving tool so as to drive in simultaneously said tool and said peg, removal of the driving tool once the peg has been completely driven into the ground, fitting of a post or stake into the sleeve of the peg.

Of course, in the case where the driving tool comprises a splayed part such as the one previously described, once the sleeve has been fitted on the anchorage piece, the process may comprise:

introduction of the tool into the sleeve of the thus formed peg, gripping then positioning of the assembly formed by the peg and the tool at the position where it is desired to set up the post or stake, driving-in the peg in the way described above.

Similarly, when it is required to adapt the driving tool to the sleeve of the peg, the process may further comprise, before introducing the shank of the tool in the sleeve of the peg, positioning of the adapting sleeve either on said shank, or in the sleeve.

The process may further comprise an additional phase for driving in the peg, slightly below the level of the ground so as to allow additional compacting of the earth around the peg.

It is clear that the above described method allows posts or stakes to be set up at a very rapid rate whatever the nature of the ground. It has the further advantage of only using simple and inexpensive materials and may be produced industrially using mass production methods.

What is claimed is:

1. A peg for anchoring posts or stakes in the ground, said peg comprising:

i an anchorage piece having an elongate shaped central web, said web extending along a driving direction of the peg and having upper and lower ends and at least two fins extending from said central web and each having an upper edge portion, and first slide assembly means provided on said central web, and ii an elongate shaped sleeve having first and second opened ends and second assembly means adapted for cooperating with said first assembly means for removably assembling said sleeve on said central web through sliding engagement along said driving direction, with said upper end of the central web, said upper edge portions of the fins and said first opened end of the sleeve being substantially located in a same plane substantially at right angles to said driving direction, and the second end of the sleeve at least reaching the lower end of the central web.

2. The peg as claimed in claim 1, wherein said first assembly means comprise elongate and flat housings which extend parallel to said driving axis on each side of said central web and second assembly means comprise lateral fins integral with the sleeve and adapted for engagement by sliding in said elongate housings.

3. The peg as claimed in claim 1, wherein said anchorage piece is formed by a single metal sheet cut out and bent, the two fins forming a splayed V shaped profile having bends, whereas said central surface portion is generally flat and forms with the bends of the fins elongate and flat housings open on one side and at their ends for receiving the bent edges of an open sleeve element.

4. The peg as claimed in claim 3, wherein said bends are external to said central flat portions and said central flat portion projects inwardly of the voume defined by the fins and said bends.

5. The peg as claimed in claim 4, wherein said inserted sleeve element is shaped and dimensioned so that the sleeve houses, by jamming it, a post which may have different shapes or sections.

6. The peg as claimed in claim 1, wherein said anchorage piece is formed by a single metal sheet cut out and bent, the two fins forming a flat or V shaped splayed profile, whereas said central web is stamped so as to have inwardly of the V two longitudinal gutters separated by an elongate boss, the stamping being carried out so as to leave one or more paired or offset tongues in the plane of the inner face of the boss, so that the bent edges of a separate open sleeve element are guided and held in position by cooperation with the gutters.

7. The peg as claimed in claim 6, wherein the flat surface common to the tongues of the same pair and to the intermediate boss is provided with stiffeners.

8. The peg as claimed in claim 1, wherein said anchorage piece comprises a central web having slits defining parts projecting on each side of the plane of the anchorage piece, said projecting parts forming collars for receiving an entirely separate sleeve.

* * * * *